United States Patent [19]

Newton

[11] Patent Number: 4,588,251

[45] Date of Patent: May 13, 1986

[54] TELEPHONE JACK ASSEMBLY

[75] Inventor: George W. Newton, Durham, N.C.

[73] Assignee: Trimm, Inc., Libertyville, Ill.

[21] Appl. No.: 725,893

[22] Filed: Apr. 22, 1985

[51] Int. Cl.[4] ..... H01R 13/50

[52] U.S. Cl. ..... 339/182 R; 339/183; 339/126 R

[58] Field of Search ..... 339/182, 183, 177 R, 339/177 E, 263 R, 220 R, 122 R, 119 R, 120, 126 R

[56] References Cited

U.S. PATENT DOCUMENTS

| | | | |
|---|---|---|---|
| 1,133,197 | 3/1915 | Thomas | 339/122 R |
| 3,537,061 | 10/1970 | Haag et al. | 339/183 |
| 3,784,962 | 1/1974 | Byrd | 339/182 R |
| 4,026,629 | 5/1977 | Dechelette et al. | 339/220 R |
| 4,368,941 | 1/1983 | Martin | 339/183 |

FOREIGN PATENT DOCUMENTS

| | | | |
|---|---|---|---|
| 2231388 | 8/1973 | Fed. Rep. of Germany | 339/183 |

*Primary Examiner*—Gil Weidenfeld
*Assistant Examiner*—David L. Pirlot
*Attorney, Agent, or Firm*—B. B. Olive

[57] ABSTRACT

A substantially-rigid telephone jack frame is formed of one piece of metal with a flanged face plate and ribbed arms for supporting the spring platform. The platform itself is formed with sides conforming with the shape of the inner surfaces of the arms to facilitate use of projection welding and to achieve added rigidity in the overall jack assembly.

8 Claims, 31 Drawing Figures

TELEPHONE JACK ASSEMBLY

DESCRIPTION

1. Technical Field

The invention relates generally to the field of electrical jacks and more specifically to an improved telephone jack frame assembly of the type adapted for side-by-side mounting in an electrical jack panel.

2. Background Art

The so-called "long frame jack" used in the telephone industry has over recent years been increasingly replaced by the so-called "94 Series" which employs a plug of 0.173 inch diameter. The 94 Series jack, because of being smaller in size than the long-frame jack, enables more jacks to be installed in a jack panel and thus increases the number of circuits that can be placed in a particular jack panel.

Use of the 94 Series jack, while becoming popular, has introduced serious concerns with regard to quality and reliability. Such concerns become significant because of the number of jacks in use and the high reliability required by the communications industry. A significant reason for the problem arising with the 94 Series jack resides in the frame design. In order for the smaller size jack to function properly and to stay in adjustment, the relationship of the jack frame face plate which carries the sleeves, also referred to here as the bushings, and the spring platform which carries the tip, ring, normalling springs and insulators must stay in precise alignment during all adjusting and operating conditions. The small size and the limited movement that the switching plug can generate gives even more reason for requiring an extremely accurate and rigid jack frame.

Jack frames may be either front or rear mounted on the jack panels. Further, trade practice requires that the jacks be available for use with a single plug, two plugs or three plugs. The jacks are therefore referred to as being made in singles, doubles and triples. Jacks are also actuated by two and three circuit plugs. These switching plugs are carefully contoured to provide the proper switching action to the jacks. Jacks are also made available in a wide range of "pile-ups" which refers to how the springs are placed on the jack frame. While other jack requirements and conditions might be stated, it can be seen from this brief description that any commercially-practical jack frame must meet a number of very precise conditions, must be reliable, and must stand up in service.

One approach that has been followed in the prior art has been that of forming the telephone jack frame of a single piece of metal. Expired U.S. Pat. No. Des. 143,308 illustrates one such frame. Expired U.S. Pat. No. 2,520,158 also illustrates a jack frame formed of a single metal stamping and emphasizes the need for rigidity to maintain alignment between the springs and the jack sleeve also later referred to as the bushing. The frame described in U.S. Pat. No. 2,520,158 however is designed and adapted for use as a long frame jack and not for use as a small 94 Series jack of the type dealt with by the present invention. Further, the frame of U.S. Pat. No. 2,520,158 requires use of space-consuming tabs for securing the jack frame to the jack panel, allows the spring/insulator assembly to be mounted from only one side of the spring platform, requires the springs to operate in close proximity to the metal forming the frame arms and provides minimal thread engagement for securing the spring/insulator assembly to the spring platform. The type frame described in U.S. Pat. No. 2,520,158 so far as is known has never gone into widespread commercial use and also, so far as is known, has never been adapted in a reduced size for the 94 Series-type jack.

U.S. Pat. No. 3,822,415 also illustrates a type of jack frame made from a single piece of metal. Advantageously, as compared to the jack frame of U.S. Pat. No. 2,520,158, the frame described in U.S. Pat. No. 3,822,415 does not require tabs for securing the frame to the jack panel and thus in that regard minimizes the space required for installing the individual jack assembly. However, the lack of needed rigidity in the frame illustrated in U.S. Pat. No. 3,822,415 will be immediately apparent by the lack of any structural means opposing bending at the juncture of the arms and the face plate of the frame. U.S. Pat. No. 3,822,415 may also be usefully referred to for additional background art which is not deemed necessary to repeat here.

Reference is also made to U.S. Pat. No. 4,368,941 which discloses both the same type single-piece metal frame as disclosed in U.S. Pat. No. 3,822,415 previously referred to but also discloses a frame, spring platform and bushings made as a single die cast piece with zinc being the indicated material. While the single die cast frame as described in U.S. Pat. No. 4,368,941 could be assumed to have greater rigidity than the formed metal frame of U.S. Pat. No. 3,822,415, certain disadvantages need to be recognized that are inherent with the die cast frame type construction. Initially it is noted that the present invention enables use of a formed metal frame made of steel and bushings made of brass, bronze or nickle-silver which are good electrical conductors. Such bushings when used with a single jack may have the outside diameter threaded for panel mounting. In contrast, the frame, spring platform and bushings of U.S. Pat. No. 4,368,941 which for practical reasons are made from zinc cause a metal to be employed which is not an appropriate choice from the viewpoint of electrical conductivity. Furthermore, the cast construction of the type frame illustrated in U.S. Pat. No. 4,368,941 also inherently means that various type bushings cannot be used with the same frame. Additionally, the cast construction does not allow the same type spring platform to be used interchangeably with the single, double or triple bushing jack assemblies as with the present invention. U.S. Pat. No. 4,368,941 is otherwise referred to as also giving useful background information to which reference may be made and which is not deemed to be necessary to repeat here. In particular, U.S. Pat. No. 4,368,941 emphasizes the critical aspects of minimizing space requirements, of having a high level of reliability, and long-term preservation of the spring and bushing alignment, all of which objectives are obtained by the present invention.

With all of the foregoing as background, the present invention seeks to provide an improved jack assembly and in particular to provide an improved frame construction which ensures long-term reliability, utilizes a single metal plate construction for forming the frame, allows various type bushings to be interchangeably used with the same type frame, ensures long-term retention of the alignment of the bushings and springs, provides substantially thread engagement for securing the spring-/insulator assembly to the spring platform and enables a standard type of frame construction to be employed for the single, the double, and the triple type jack assemblies. Other objects of the invention will become apparent as the description proceeds.

DISCLOSURE OF INVENTION

An improved jack assembly is provided in which the jack frame is formed of a single piece of metal with a flange and rib construction which ensures long-term alignment of the bushings and springs. The same basic type of frame construction is illustrated as being adapted to the single, the double, and the triple type bushing jack assemblies. The spring platform is made up of one or more mounting blocks secured between the frame arms by welding, brazing or soldering with a unique configuration being used to allow projection-type welding.

BEST MODE FOR CARRYING OUT THE INVENTION

Figure 1:
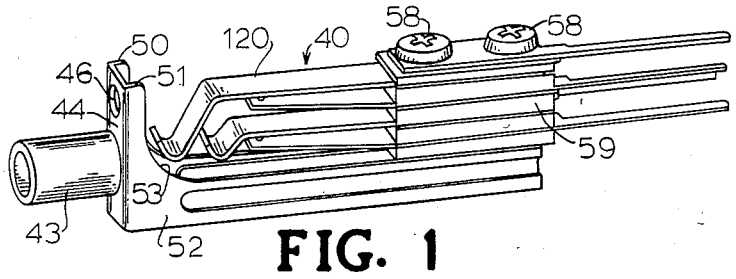
FIG. 1 is a perspective view of a single bushing jack assembly according to the invention.
Figure 2:
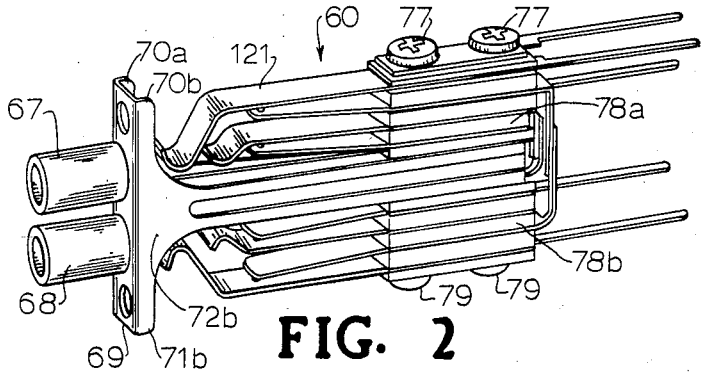
FIG. 2 is a perspective view of a double bushing jack assembly according to the invention.
Figure 3:
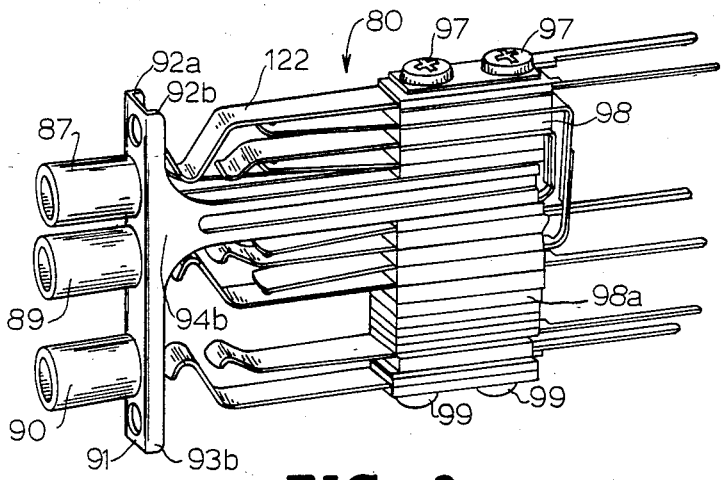
FIG. 3 is a perspective view of a triple bushing jack assembly according to the invention.

As previously stated, the invention provides improvements in the frame, per se, in the insulator mounting blocks or spring platform, to a lesser degree in the spring construction, and in the overall jack assembly made up of the frame, the mounting blocks, and the spring/insulator assembly. Reference is initially made to FIGS. 1–3 in which there is illustrated in FIG. 1 an improved single bushing jack assembly 40, in FIG. 2 an improved double bushing jack assembly 60, and in FIG. 3 an improved triple bushing jack assembly 80, all of which embody an improved frame construction, an improved mounting block construction, and an improved spring construction according to the invention, the details of which reference is next made.

Figure 4:
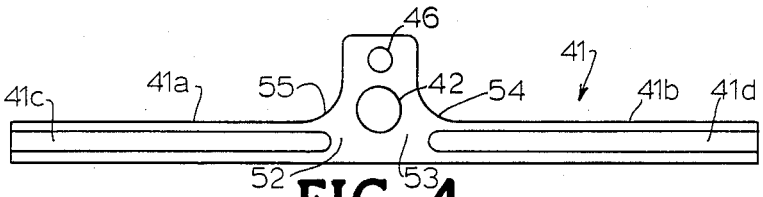
FIG. 4 is a plan view of a sheet metal blank formed with ribs and apertures preliminary to being formed in a subsequent operation as a single bushing type jack frame.
Figure 5:
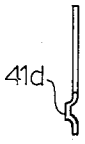
FIG. 5 is an end view of the metal blank illustrated in FIG. 4.
Figure 12:
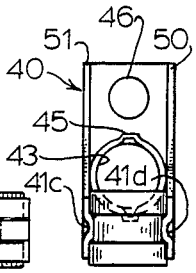
FIG. 12 is a right end view of FIG. 10.
Figure 14:
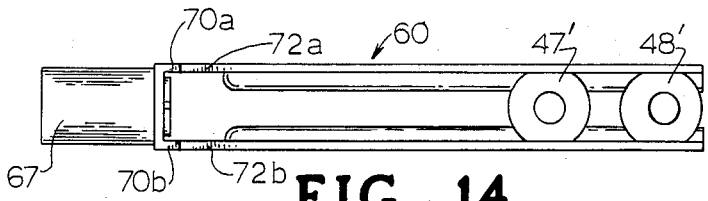
FIG. 14 is a plan view of the double bushing jack frame of the invention with the bushing and mounting blocks installed.
Figure 15:
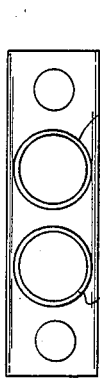
FIG. 15 is a left end view of FIG. 14.
Figure 17:
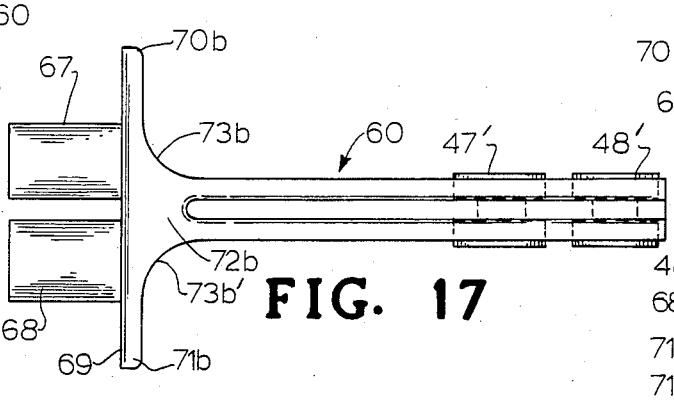
FIG. 17 is a side view of the double bushing jack frame of FIG. 14.
Figure 16:
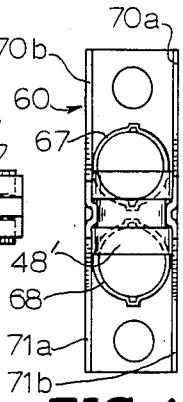
FIG. 16 is a right end view of FIG. 14.
Figure 22:
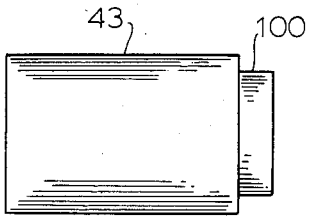
FIG. 22 is a side view of a representive bushing or sleeve.
Figure 23:
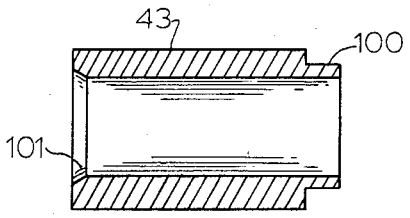
FIG. 23 is a section view of the bushing seen in FIG. 22.

Making reference next to the drawings and particularly FIGS. 4–13, each of the single, double, and triple jack assembles 40, 60 and 80 incorporate a frame formed from a single sheet metal plate, with 22 gauge cold rolled steel being a preferred material. FIGS. 4–5 illustrate the frame 41 in its first stamped form prior to being finish-formed as in FIG. 1. Frame 41 incorporates an aperture 42 for receiving and mounting the single metal bushing 43 at a right angle to the face plate 44. All of the bushings employed in the various jack assemblies illustrated in FIGS. 1–3 are of a common construction and may be made of brass, bronze or a nickle-silver alloy. The outside diameter of the single jack bushing may be threaded when required for panel mounting. As seen in FIG. 22, the bushings have a reduced end portion 100 which in the case of bushing 43 is mounted in aperture 42 and is then staked at a pair of diametrically-opposite stake positions, one of which 45 is seen in FIG. 12 for firm securement. A tapered entry 101 facilitates insertion of the jack. Face plate 44 also includes an aperture 46 by means of which the jack is adapted to be attached to a mounting panel, not shown. The respective jack assemblies 40, 60 and 80 may be either front or rear mounted to the jack panel. When rear mounted, in the case of jack assembly 40, aperture 46 is formed as a clearance hole and a screw is passed through clearance hole 46 and driven into a tapped hole in the jack panel. When jack assembly 40 is front mounted, the jack panel has a clearance hole through which a screw is placed and driven into aperture 46 which for such front mounting is formed as an extruded threaded opening in face plate 44. The double jack assembly 60 and triple jack assembly 80 are mounted on the jack panel in a similar manner.

Figure 6:
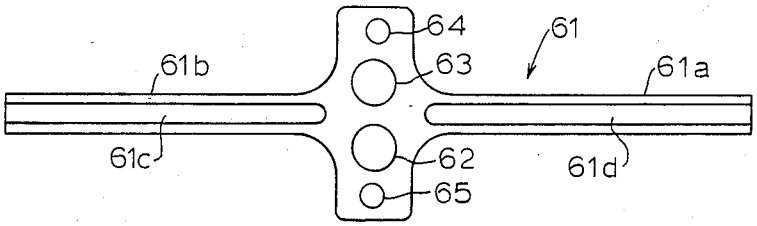
FIG. 6 is a plan view of a sheet metal blank formed with ribs and apertures preliminary to being formed in a subsequent operation as a double bushing type jack frame.
Figure 7:
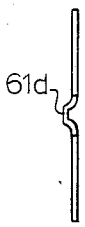
FIG. 7 is an end view of the metal blank illustrated in FIG. 6.
Figure 8:
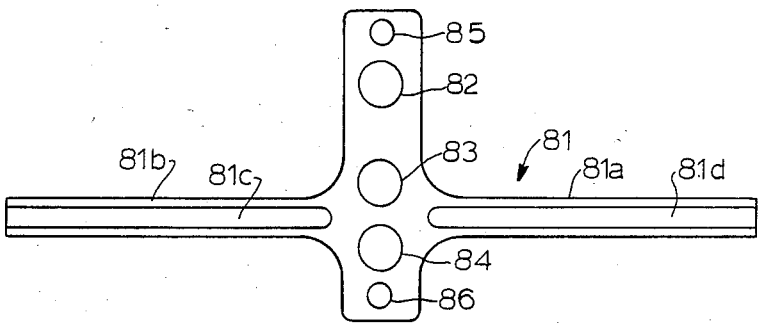
FIG. 8 is a plan view of a sheet metal blank formed with ribs and apertures preliminary to being formed in a subsequent operation as a triple bushing type jack frame.
Figure 9:
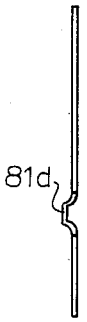
FIG. 9 is end view of the metal blank illustrated in FIG. 8.
Figure 10:
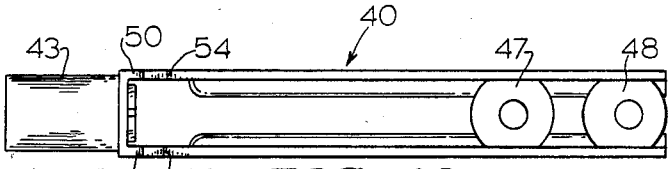
FIG. 10 is a plan view of the single bushing jack frame of the invention with the bushing and mounting blocks installed.
Figure 11:
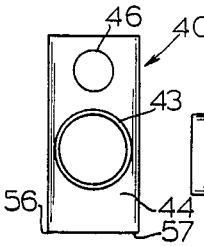
FIG. 11 is a left end view of FIG. 10.
Figure 13:
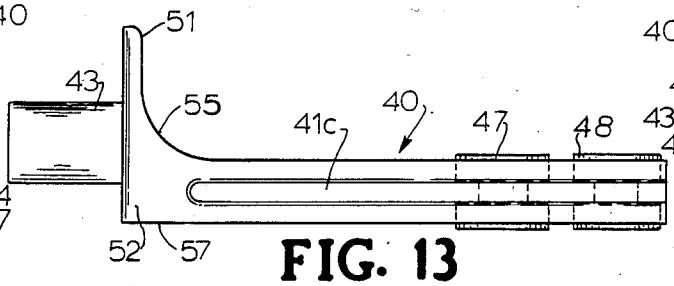
FIG. 13 is a side view of the single bushing jack frame seen in FIG. 10.

Referring back to FIGS. 4–5, frame 41 incorporates a pair of outwardly-extending arms 41*a*, 41*b* formed for the length thereof with respective ribs 41*c*, 41*d* which serve both to stiffen the frame and also as a unique means for mounting and securing the mounting blocks 47, 48, as seen in FIG. 10 and later described. In a similar manner as seen in FIGS. 6–7, frame 61 for the double jack assembly 60 incorporates bushing apertures 62, 63, jack-mounting apertures 64, 65; arms 61*a*, 61*b*; and ribs 61*c*, 61*d*. Frame 81 for the triple jack assembly 80, as seen in FIGS. 8–9, will also be seen as including bushing apertures 82, 83 and 84, jack-mounting apertures 85, 86, arms 81*a* and 81*b*, and ribs 81*c* and 81*d*. Bushings 67, 68 mount in right angular relation on face plate 69 of frame 61 of the double jack assembly 60 and are secured by staking as previously explained. Bushings 87, 89 and 90 mount in right angular relation on face plate 91 of frame 81 of the triple jack assembly 80 and are also secured by staking as previously explained.

The respective frames 41, 61, and 81 when bent from the respective positions seen in FIGS. 4, 6 and 8 to the comparable respective positions seen in FIGS. 1–3 are each formed with additional strengthening flanges. The flanges are formed such that each of the respective face plates 44, 69 and 91 for the respective single, double and triple jack assemblies 40, 60 and 80 are provided with strengthening and stiffening flanges extending rearwardly and at a right angle from each edge of the respective face plate and for the full length thereof and with the respective frame arms extending outwardly therefrom. Using the single jack assembly 40 as an example of such flange construction, it will be seen that flanges 50, 51 effectively form extensions of the frame side panels 52, 53 from which the arms 41*a*, 41*b* extend. Also to be seen is that the frame side panels 52, 53 also effectively form flanges for face plate 44. Side panels 52, 53 in the example of the single jack assembly 40 will also be seen as being bounded by upper curved edges 54, 55 and lower straight edges 56, 57.

With the foregoing description of the single jack assembly flange construction in mind, it will be seen from FIGS. 14–17 that the double jack assembly 60 also incorporates as right angled extensions from face plate 69 an upper pair of flanges 70*a*, 70*b*, a lower pair of flanges 71*a*, 71*b*, and intermediate side panels 72*a*, 72*b*. Side panel 72*b* is also illustrated as being between an upper curved edge 73*a* and a lower curved edge 73*b*. While not identified, it will be understood that the opposing side panel 72*a* has similar upper and lower curved edges. In a similar manner, the triple jack assembly 80 includes as right-angled extensions from face plate 91 an upper pair of flanges 92*a*, 92*b*, a lower pair of flanges 93*a*, 93*b*, and intermediate side panels 94*a*, 94*b*. Side panel 94*b* is illustrated as being between an upper curved edge 95*a* and a lower curved edge 95*b*. While not identified, it will also be understood that the opposite side panels have similar curved edges.

Figure 18:
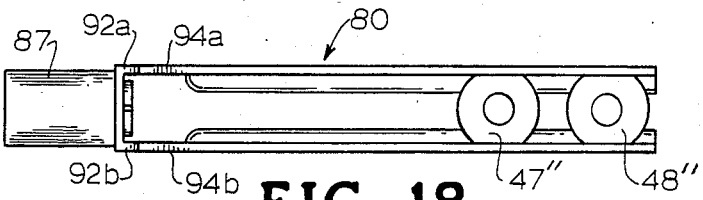
FIG. 18 is a plan view of the triple bushing jack frame of the invention.
Figure 19:
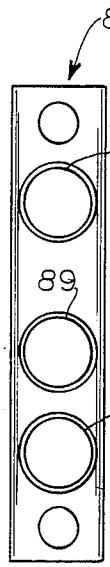
FIG. 19 is a left end view of FIG. 18.
Figure 21:
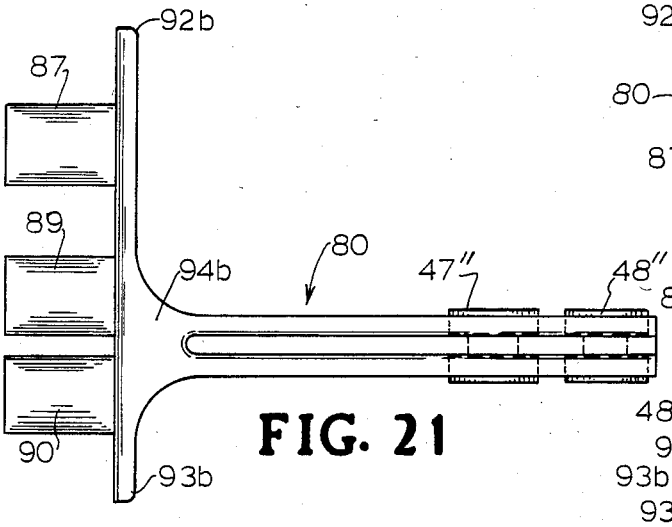
FIG. 21 is a side view of the triple bushing jack frame shown in FIG. 18.
Figure 20:
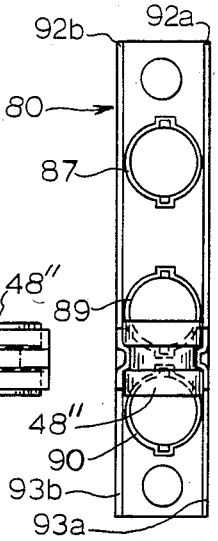
FIG. 20 is a right end view of FIG. 18.
Figure 24:
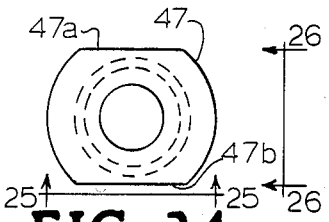
FIG. 24 is a plan view of one of the mounting blocks according to a first embodiment.
Figure 25:
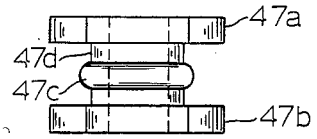
FIG. 25 is a side view of the mounting block taken in the direction of line 25—25 of FIG. 24.
Figure 26:
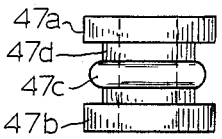
FIG. 26 is an end view of the mounting block taken in the direction of line 26—26 of FIG. 24.

The respective single, double and triple jack assemblies 40, 60, and 80 are each adapted to incorporate a similar type of spring platform. In a first embodiment of such spring platform illustrated in FIGS. 10, 12 and 13 for the single jack assembly 40 in FIGS. 14, 16 and 17 for the double jack assembly 60 and in FIGS. 18, 20 and 21 for the triple jack assembly 80, the platform comprises a pair of metal spacer blocks, each of the type construction illustrated in detail in FIGS. 24–26. Spacer blocks 47, 48 are identified for the single jack assembly 40, spacer blocks 47', 48' for the double jack assembly 60 and spacer blocks 47'', 48'' for the triple jack assembly 80. Cold rolled steel is a suitable material. With particular reference to FIGS. 24–26 in which spacer block 47 is used by way of example, it will be noticed that block 47 is formed somewhat as a cylindrical spool with flat faced rim portions 47*a*, 47*a'*, 47*b*, 47*b'* and an annular, outwardly-curved, centrally-located bead 47*c* surrounding a hollow, cylindrical body portion 47*d*.

With continued reference to the single jack assembly 40 and FIGS. 10–13, it will be noticed that blocks 47, 48 are located between the arms 41*a*, 41*b* with the mentioned flat faced rim portions 47*a*, 47*a'*, 47*b*, 47*b'* facing corresponding internal flat surfaces of the arms 41*a*, 41*b* and the bead 47*c* in contact with the ribs 41*c*, 41*d*. Once so assembled, blocks 47, 48 are welded by a projection welding technique during which the bead 47*c* is melted and flattened and welded to the arms 41*a*, 41*b*, at ribs 41*c* and 41*d*. Blocks 47, 48 may also be brazed or soldered to the frame. In a similar manner, spacer blocks 47, 48 are welded to arms 61*a*, 61*b* of the frame 61 of the double jack assembly 60 and spacer blocks 47, 48 95, 96 are welded to the arms 81*a*, 81*b* of the frame 81 of the triple jack assembly 80.

Each of the spacer blocks is internally threaded for receiving a pair of screws such as screws 58 in FIG. 1 for securing a single insulator/spring assembly 59 of the single jack assembly 40. In the double jack assembly 60 of FIG. 2, an upper pair of screws 77 secure an upper insulator/spring assembly 78 and a lower pair of screws 79 secured a lower insulator/spring assembly 78*b*. In the triple jack assembly of FIG. 3, an upper pair of screws 97 secure an upper insulator/spring assembly 98 and a lower pair of screws 99 secured a lower insulator/spring assembly 98*a*.

Figure 27:
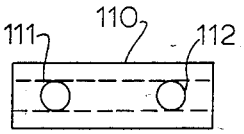
FIG. 27 is a plan view of an alternative mounting block.
Figure 28:
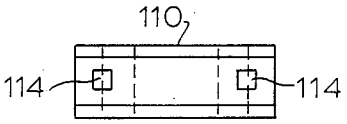
FIG. 28 is a side view of the mounting block seen in FIG. 27.
Figure 29:
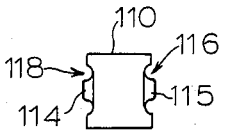
FIG. 29 is an end view taken in the direction of line 29—29 of FIG. 27.

An alternative spring platform is provided by a single block member 110 shown in FIGS. 27–29 in which there is provided a pair of threaded apertures 111, 112. A pair of tips or protrusions 114, 115 within slots 116, 118 are formed on opposite sides of the block member 110. Tips 114, 115 are welded by the previously-mentioned projection welding technique in the manner of welding bead 47*c*. While not illustrated, it will be readily understood that block member 110 is received between any of the pairs of arms as the substitute for the previously described mounting blocks to serve the same function.

While not shown in detail, it is also to be mentioned that the springs such as springs 120, 121 and 122 are tapered at the plug-receiving end as required to facilitate movement of such springs between the arms of the jack frame.

Figure 30:
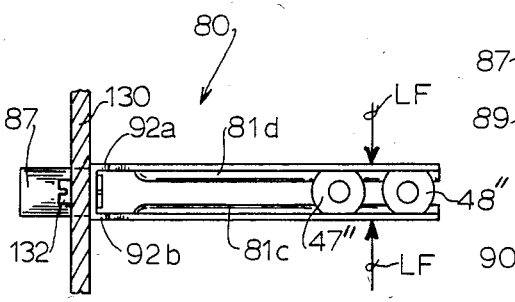
FIG. 30 is a diagrammatic representation illustrating how the improved jack frame of the invention provides lateral stability.
Figure 31:
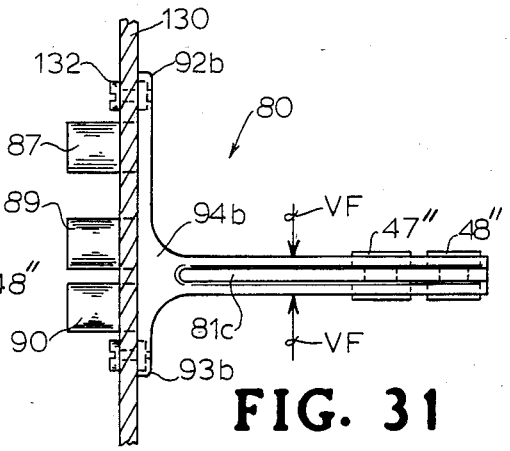
FIG. 31 is a diagrammatic representation illustrating how the improved jack frame of the invention provides beam strength and angular stability.

Final reference is made to FIGS. 30, 31 in which the illustrated arrows indicate those forces to which the improved jack frame of the invention readily resists to thereby maintain the desired alignment of the bushings and springs. Using the triple bushing jack assembly 80 by way of example in both FIGS. 30 and 31, assembly 80 is shown secured to a panel 130 by means of front-mounted screws 132. In FIG. 30, it can be seen that ribs 81*c*, 81*d* with mountings blocks 47'', 48'' resist lateral forces LF and provide beam strength whereas vertical forces VF are resisted by ribs 81*c*, 81*d*, by mounting blocks 47'', 48'', by the upper flanges 92*a*, 92*b*, by the lower flanges 93*a*, 93*b* and by the side panels 94*a*, 94*b*. Thus, overall substantial stiffness, rigidity and beam strength are provided in all embodiments.

In summary, it can be seen that the principal objective of maintaining long-term alignment of the bushings and springs has been realized along with the advantage of minimizing space and utilizing a spring platform construction which can be interchangeably used with either the single, double, or triple type jack assembly. The cost of assembly has been reduced by substantially eliminating the need for spring adjustment. The ability to use preformed springs with accurately stacked insulator spacers has provided a jack with proper contact pressure, correct spring follow and overall, a jack of high reliability. Additionally, it will also be seen that the invention provides a common type of frame construction readily adapted to either the single, the double, or the triple type jack assembly.

What is claimed is:

1. A telephone jack assembly, comprising:

(a) a metal jack frame having:

(i) a rectangular face plate;

(ii) a selected number of first openings in said face plate for receiving a comparable number of jack bushings;

(iii) a pair of side arms disposed at a right angle to and formed integral with said face plate;

(iv) a centrally-located rib formed in and extending lengthwise of each said arm and extending toward the rib formed in the opposite said arm thereby providing a pair of inwardly-directed opposed said ribs between said arms;

(v) a selected number of second openings in said face plate each being adapted for receiving a fastener to secure the assembly to a jack panel; and (vi) flange portions disposed at right angles to and formed integral with said face plate on each side thereof and residing in the plane of said arms, said arms forming continuations of said flange portions;

(b) a selected number of bushings equal to the said selected number of first openings secured to said face plate and extending outwardly therefrom in right angle relation; and (c) spring platform means mounted between said arms and comprising metal block structure having side faces corresponding to the shape of the inner faces of said arms above and below said ribs, said metal block structure being integrally secured to said arms at the juncture of said faces and having threaded holes for receiving screws to secure a spring/insulator assembly.

2. A telephone jack assembly as claimed in claim 1 including a spring/insulator assembly secured by screws to said block structure.

3. A telephone jack assembly as claimed in claim 1 including a pair of spring/insulator assemblies secured by screws to opposite sides of said block structure.

4. A telephone jack assembly as claimed in claim 1 wherein said block structure includes a pair of beads located to mate said ribs and to be melted when said block structure is integrally secured to said arms.

5. A telephone jack assembly as claimed in claim 1 wherein said block structure comprises a single block member having a pair of apertures for receiving a said spring/insulator assembly.

6. A telephone jack assembly as claimed in claim 5 wherein said single block structure includes a plurality of protrusions located to mate said ribs and to be melted when said single block structure is integrally secured to said arms.

7. A telephone jack assembly as claimed in claim 1 wherein said block structure comprises a pair of mounting blocks spaced lengthwise of said arms and having threaded holes for receiving screws to secure a spring insulator assembly thereon.

8. A telephone jack assembly as claimed in claim 7 wherein each said mounting block includes a pair of beads located to mate said ribs and to be melted when each block structure mounting block is integrally secured to said arms.

* * * * *